US008820007B2

(12) United States Patent
Knudsen

(10) Patent No.: US 8,820,007 B2
(45) Date of Patent: Sep. 2, 2014

(54) DEVICE FOR FORMING POST SLEEVES, AND METHOD OF USE

(76) Inventor: N. Eric Knudsen, Maple Valley, WA (US)

( * ) Notice: Subject to any disclaimer, the term of this patent is extended or adjusted under 35 U.S.C. 154(b) by 106 days.

(21) Appl. No.: 13/243,843

(22) Filed: Sep. 23, 2011

(65) Prior Publication Data

US 2013/0061555 A1 Mar. 14, 2013

Related U.S. Application Data

(60) Provisional application No. 61/533,702, filed on Sep. 12, 2011.

(51) Int. Cl.

| | |
|---|---|
| ***E04B 1/38*** | (2006.01) |
| ***E02D 27/42*** | (2006.01) |
| ***E04H 12/00*** | (2006.01) |
| ***E21B 7/26*** | (2006.01) |
| ***E21B 7/28*** | (2006.01) |
| ***E21B 17/00*** | (2006.01) |
| ***E21B 17/10*** | (2006.01) |
| ***A45F 3/44*** | (2006.01) |
| ***F16M 13/00*** | (2006.01) |
| ***E04H 12/22*** | (2006.01) |
| ***E04C 3/00*** | (2006.01) |
| ***E02D 5/80*** | (2006.01) |
| ***E04G 21/02*** | (2006.01) |
| ***E01F 9/011*** | (2006.01) |
| *E04H 17/22* | (2006.01) |

(52) U.S. Cl.

CPC ..... *E02D 27/42* (2013.01); *E04H 12/22* (2013.01); *E04H 12/2269* (2013.01); *E04C 3/00* (2013.01); *E04H 17/22* (2013.01); *E02D 5/80* (2013.01); *E04G 21/02* (2013.01); *E01F 9/0117* (2013.01)

USPC ..... 52/165; 52/127.5; 52/155; 52/159; 52/162; 52/158; 52/300; 52/301; 52/741.11; 52/298; 175/22; 175/23; 175/281; 175/288; 175/321; 175/325.7; 248/545; 248/523; 248/156

(58) Field of Classification Search

USPC ..... 52/127.5, 159, 165, 155, 632, 300, 301, 52/298, 162–164, 158, 741.1; 175/22, 23, 175/281, 288, 321, 325.7; 248/545, 523, 248/156

See application file for complete search history.

(56) References Cited

U.S. PATENT DOCUMENTS 978,505 A * 12/1910 Stewart ..... 52/155
1,224,926 A * 5/1917 Hindmarsh ..... 52/155

(Continued)

FOREIGN PATENT DOCUMENTS

KR 10-0991886 B1 11/2010
WO 2007/064235 A1 6/2007

*Primary Examiner* — Phi A
*Assistant Examiner* — Omar Hijaz
(74) *Attorney, Agent, or Firm* — Seed IP Law Group PLLC

(57) ABSTRACT

A post sleeve installation assembly includes: an elastomeric sleeve core shaped to form a post sleeve when positioned in uncured concrete, a removable stiffener inside the core, an aperture extending lengthwise in the stiffener, a locking element positioned within the core, and an assembly plate coupled to the stiffener. The assembly plate clamps to a prefabricated sleeve element, with the core and stiffener positioned within a post cavity of the sleeve element. an installation stake is positioned in the aperture and prevented from sliding upwards by the locking element. A release point on the assembly plate permits an operator to release the locking element for removal of the stake. To install a post sleeve, the operator positions the installation assembly, clamped to a prefabricated sleeve element, in a post hole with the stake resting on the bottom, then fills the hole with concrete, manipulating the stake to position the assembly.

12 Claims, 15 Drawing Sheets

(56) References Cited

U.S. PATENT DOCUMENTS

| | | | | | |
|---|---|---|---|---|---|
| 1,906,706 | A | * | 5/1933 | Moore | 175/21 |
| 3,638,741 | A | * | 2/1972 | Zizak | 175/215 |
| 3,824,748 | A | * | 7/1974 | Pichowicz | 52/103 |
| 3,894,589 | A | * | 7/1975 | Ciraud | 175/23 |
| 4,133,154 | A | | 1/1979 | Ruzicka | |
| 4,787,601 | A | * | 11/1988 | Rybak | 256/19 |
| 4,926,785 | A | * | 5/1990 | Lamson | 116/209 |
| 4,986,373 | A | * | 1/1991 | Charland et al. | 175/21 |
| 5,339,909 | A | * | 8/1994 | Jenne et al. | 175/22 |
| 5,542,481 | A | * | 8/1996 | Scott | 175/23 |
| 5,632,464 | A | | 5/1997 | Aberle | |
| 5,752,349 | A | * | 5/1998 | Fitzsimmons et al. | 52/165 |
| 5,992,103 | A | * | 11/1999 | Norman et al. | 52/155 |
| 6,098,353 | A | | 8/2000 | Stanfield | |
| 6,267,688 | B1 | * | 7/2001 | Morelli, Sr. | 473/179 |
| 6,991,413 | B2 | * | 1/2006 | Ballou et al. | 411/15 |
| 7,055,807 | B2 | * | 6/2006 | Pesta | 256/65.14 |
| 7,325,790 | B2 | | 2/2008 | Lee | |
| 7,621,098 | B2 | * | 11/2009 | Reinert, Sr. | 52/742.1 |
| 7,861,434 | B2 | | 1/2011 | Knudsen | |
| 7,954,289 | B2 | | 6/2011 | Evans | |
| 2003/0121223 | A1 | * | 7/2003 | Riker | 52/296 |
| 2009/0320396 | A1 | * | 12/2009 | Knudsen | 52/297 |
| 2010/0277290 | A1 | | 11/2010 | Knudsen | |
| 2011/0098969 | A1 | | 4/2011 | Knudsen | |
| 2012/0311947 | A1 | * | 12/2012 | Van Wissen | 52/250 |
| 2013/0042547 | A1 | | 2/2013 | Carhart | |

* cited by examiner

DEVICE FOR FORMING POST SLEEVES, AND METHOD OF USE

BACKGROUND OF THE INVENTION

1. Technical Field

The embodiments of the present disclosure are related in general to the field of installation of supports for uprights of fences, traffic signs, real estate signage, etc., and in particular to post supports that can be permanently installed, and from which one post can be removed and another emplaced.

2. Description of the Related Art

A post is a substantially straight, elongated columnar structure that is anchored at one end so as to stand upright, and that supports thereon another structure. A post can be made of any appropriate material, including wood, metal, concrete, or plastic. Posts of various lengths and compositions are used in a wide range of applications, including supporting fences, traffic control signs, temporary structures, etc. Where a post is intended to be substantially permanent, it is often placed in a hole and anchored in a concrete footing to increase its cross section so as to be held firmly in place by the surrounding earth. One problem that is commonly encountered in such situations is that posts, especially wooden posts, are subject to breakage, warpage, and decomposition. Replacing a post that has been anchored in concrete is difficult, wasteful, and unfriendly to the environment for reasons that include excessive use of natural resources and the generation of landfill material. The concrete footing must be removed from the ground in order to make room for the new post. This requires that a much larger hole must be dug around the concrete footing. In turn, this requires a much larger volume of concrete or re-compaction of the surrounding soil, to fill the hole around the new post and create the new footing in proper contact with undisturbed or adequately compacted soil.

One of the most common causes of deterioration in wooden posts is water trapped around the end of the post inside the concrete. For example, when the post is damp or wet for an extended period of time, the wood absorbs water and draws it by capillary action downward into the concrete footing. Water becomes trapped between the wood and the inside wall of the concrete, so that the end of the post remains wet even while the upper portion is dry. This is especially true in cases where the end of the post is completely encapsulated in concrete, preventing water from escaping through the bottom of the footing, in which case the majority of the water escapes only through the wicking action of the end grain of the post.

To reduce this problem, installers often pour several inches of gravel into the bottom of a post hole and place the post directly on the gravel before they pour concrete around it. This prevents the concrete from completely sealing up the bottom of the post by flowing under it, and thus provides a channel for water to escape into the gravel. However, this is only a partial solution. Often the drainage gravel is not fully compacted and settles, causing more need for repair and replacement. Furthermore, with this common method, it takes substantial time for water, once having entered the footing, to work its way all the way through the footing and out the bottom. If the post is subjected to frequent or extended wet periods, the end of the post inside the footing may remain constantly wet even though water continues to drain out the bottom. Additionally, because of the direct contact with the ground on the end of the post, water can move upward into the footing when the ground is wet, due to the capillary or wicking effect of the end grain. This constant dampness encourages the growth of organisms that digest the wood fiber and eventually destroy the post, or in the case of steel, rusts the post away. Additionally, the bottom of the footing is substantially open to insects, which can enter unobstructed from the gravel below to attack and eat the post.

Another approach that is used to protect wood posts and other lumber in direct contact with the ground or with concrete is commonly referred to as pressure treating. In this process, protective chemicals are forced into an outer surface of the post under high pressure. The chemicals provide the post with protection from common funguses and other organisms that cause deterioration. Pressure treatment generally extends the useful life of a post by a factor of five to ten. However, the chemicals used in pressure treatment are often toxic to humans and non-target organisms, and can leach into the water supply. In other cases, the chemicals are highly corrosive, tending to cause corrosion in fasteners and structures that are attached thereto. An additional problem with pressure treatment is that the wood cannot generally be recycled when it is replaced, and should not be composted, because of the chemicals still present. This means that it must be deposited in a landfill which in turn is a result of the need to install a post in direct contact with the ground and or concrete.

A third approach to this problem is the use of prefabricated anchors or sleeves, i.e., pockets or sleeves that are placed in the ground or anchored in a concrete footing. These anchors permit a post to be removed and replaced without requiring that the sleeve itself be replaced. Some examples of such anchors and methods of installation are disclosed in the following U.S. patents and Patent Application Publications, all of which are incorporated herein by reference in their entireties: US Publication No. 2009/0320396; US Publication No. 2010/0277290; U.S. Pat. No. 5,632,464; U.S. Pat. No. 6,098,353; U.S. Pat. No. 7,325,790; and U.S. Pat. No. 7,861,434.

BRIEF SUMMARY

According to an embodiment, a post sleeve installation assembly includes an elastomeric sleeve core shaped to form a post sleeve when positioned in an uncured concrete footing, a stiffener removably positioned inside the core with an aperture extending lengthwise therein, a locking element positioned within the sleeve core, and an assembly plate coupled to the stiffener. The assembly plate is configured to attach to a prefabricated sleeve element, with the sleeve core and stiffener positioned within a post cavity of the sleeve element. An installation stake is positioned in the aperture and prevented from sliding upwards by the locking element. A release point on the assembly plate permits an operator to release the locking element and permit removal of the stake.

To install a post sleeve, the operator positions the installation assembly, including a prefabricated sleeve element clamped thereto, in a post hole with the stake resting on the bottom. The hole is filled with concrete, and while wet, the operator positions the assembly as desired. The operator can manipulate the upper end of the stake to position the sleeve, or can use other positioning means. When the concrete is cured, the operator drives the stake a few inches downward to break through any concrete that may have hardened below the stake, thereby ensuring drainage of the post sleeve to below the concrete footing. The operator then releases and withdraws the stake, removes the assembly plate and stiffener, and finally removes the elastomeric sleeve core, leaving a complete post sleeve formed in part by the sleeve element and in part by the sleeve core.

According to an embodiment, a prefabricated sleeve element is provided, including a post cavity extending therethrough. A post sleeve sock is attached to a lower end of the post cavity, and is configured to receive the lower end of a post positioned in the cavity. To form a complete post sleeve, a post is positioned in the sleeve element with its lower end encased in the sock. The assembly is placed in a post hole which is then filled with concrete. The sock prevents the concrete from adhering to the post, and is preferably of a thickness and pliancy sufficient to permit removal of the post. The sock may be configured to deteriorate over time, so that, initially, the post is held firmly in the concrete footing. After the sock has deteriorated, removal of the post is possible.

DETAILED DESCRIPTION

Figure 1:
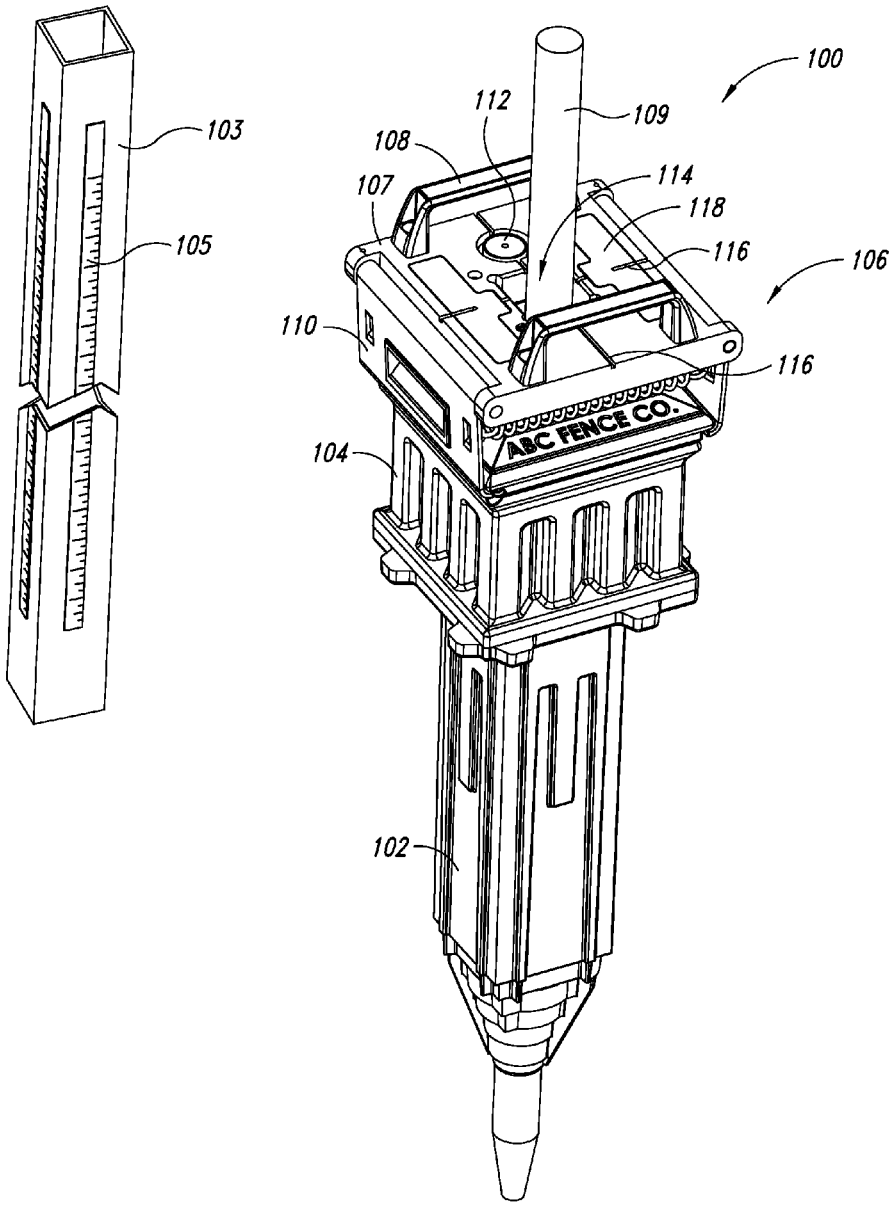
FIG. 1 is a perspective view of a post sleeve assembly according to an embodiment.

FIG. 1 shows a post sleeve assembly 100 according to an embodiment, that includes an elastomeric core 102, a prefabricated sleeve cap 104, and an installation assembly 106. Also shown are a reference index 103 and an installation stake 109. The reference index 103 includes a position scale 105.

The installation assembly 106 includes a top plate 107 to which other components of the assembly are attached, including handles 108, clamps 110, a bullseye level 112, alignment guides 116, and cam release buttons 118. Each of these elements will be described later in more detail. A central cavity 114 is provided in the top plate and sized to receive the reference index 103 for use during installation of a post sleeve.

Figure 2:
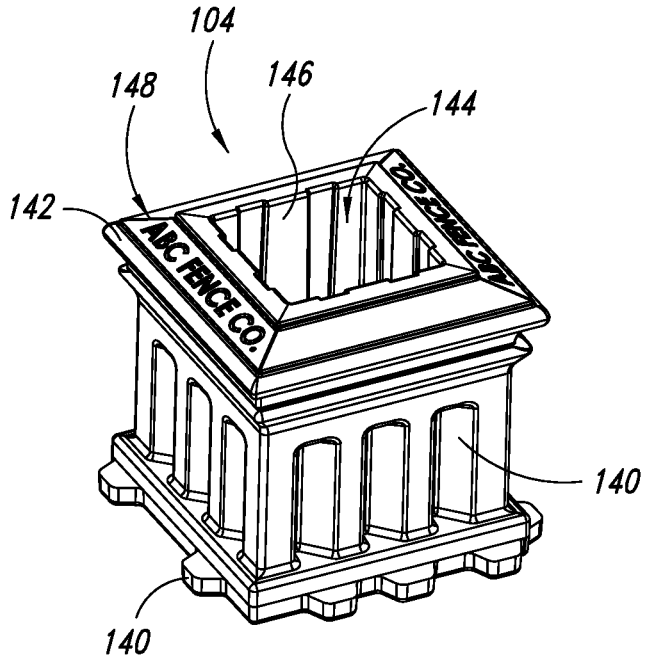
FIG. 2 is a perspective view of a sleeve cap of the assembly of FIG. 1.

FIG. 2 is a perspective view of the sleeve cap 104. The sleeve cap 104 is a prefabricated component that is made, preferably, from high-strength concrete, and is configured to be fixed in a concrete footing as the upper portion of a post sleeve. The sleeve cap 104 includes various features configured to be engaged by the wet concrete of the footing during installation to provide a secure lock between the cap and the footing. These features include a plurality of cavities 140 spaced around the outer sides of the cap, and tabs 141 extending from the bottom edge of the cap. In addition to providing structure to which the concrete footing can lock, the tabs 141 also provide advantages during transport of the sleeve cap, as will be explained in detail later. The sleeve cap 104 includes an upper rim 142 that extends at an angle out from the body of the cap, and serves to drain rain water away from the post sleeve. The upper rim 142 can be provided with graphics, such as, e.g., the name or logo of the manufacturer, as shown in FIG. 2, or can be textured to resemble stone, or otherwise decorated. A post cavity 144 extends through the sleeve cap 104, configured to receive a post having selected dimensions. Stand-off ribs 146 are sized to contact the surface of a post having the selected dimensions, when such a post is positioned therein. The ribs 146 define between them channels that permit water to drain to the bottom of the post cavity 144, even with a post positioned in the cavity.

Figure 3:
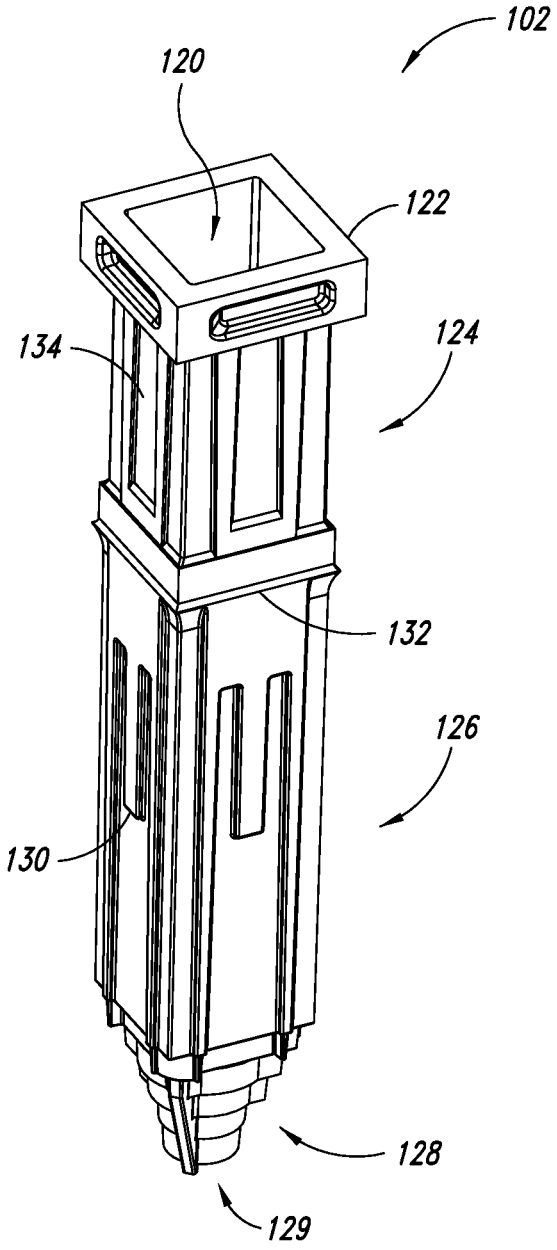
FIG. 3 is a perspective view of an elastomeric core according to an embodiment.

FIG. 3 is a perspective view of an elastomeric core 102, according to an embodiment. The core 102 includes an upper portion 124, a main body 126, and a lower portion 128. An upper rim 122 extends above the upper portion 124 and has lateral dimensions that are greater than those of the upper portion. A seal ridge 132 defines the transition between the upper portion and the main body. A stiffener cavity 120 extends through the core. The upper portion 124 of the core 102 is configured to fit inside the post cavity 144 of the sleeve cap 104. Because the core is made from an elastomeric material and is hollow, it can be collapsed onto itself to permit insertion into, and removal from the post cavity 144 of the post sleeve cap 104. The elastomeric material of the post sleeve core 102 can be, for example, synthetic rubber or silicone.

Selected features 134 of the upper portion 124 of the core 102 are provided to mate with corresponding features in the interior of the post cavity 144, such as, for example, the stand-off ribs 146. When the elastomeric core 102 is positioned in the post cavity 144, the seal ridge 132 of the core lies against the bottom of the sleeve cap 104. The seal ridge 132 acts to retain the core 102 in its proper position and to prevent wet concrete from oozing into the post cavity 144 during installation.

The main body 126 and lower portion 128 of the core 102 are provided with negative shapes corresponding to selected features to be formed within the post sleeve. In the embodiment of FIG. 3, exemplary shapes are shown that correspond, for example, to plate stops 130, drain channels 131, and a universal socket formed in the lower portion 128. These and other elements are described in detail in the '396 and '290 publications referenced and incorporated above. An aperture 129 is provided in the lower portion 128, through which the installation stake 109 passes.

Figure 4:
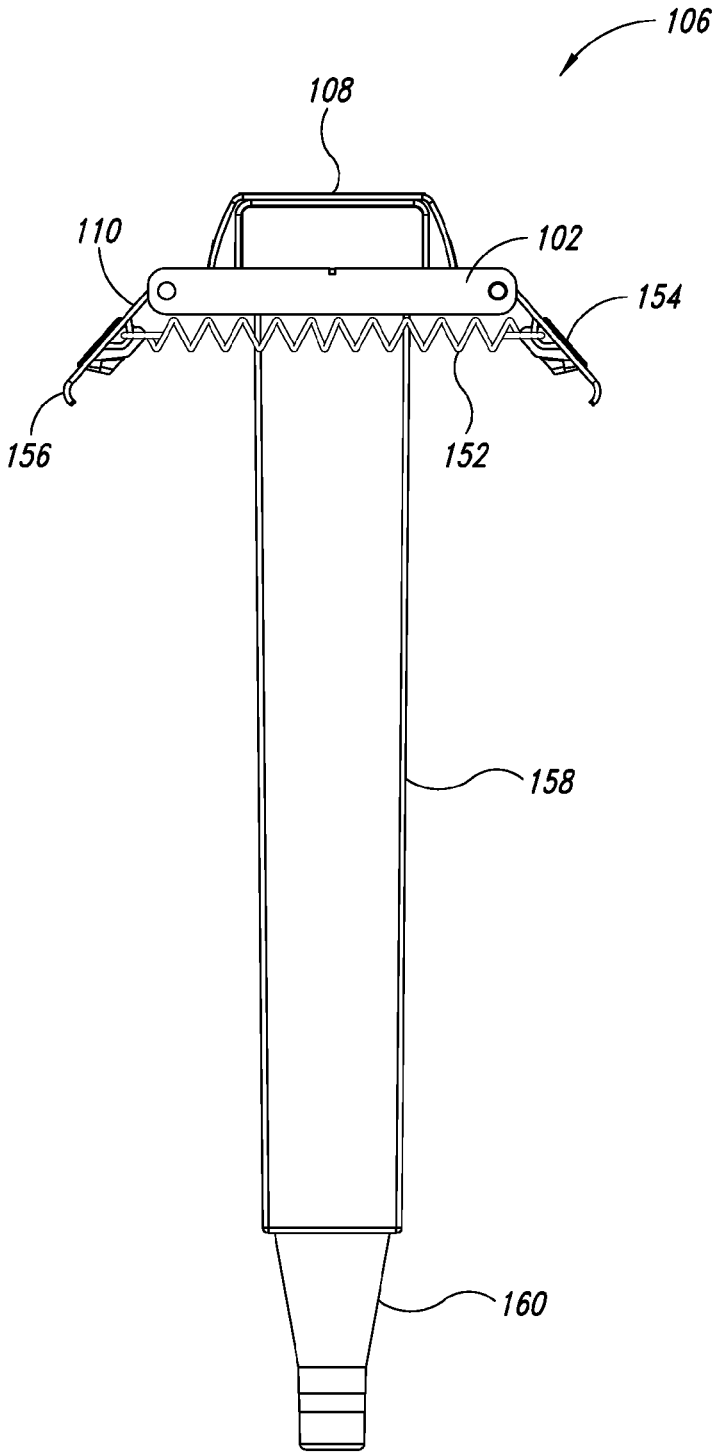
FIG. 4 is a side elevation view of an installation assembly according to the embodiment of FIG. 1.
Figure 5:
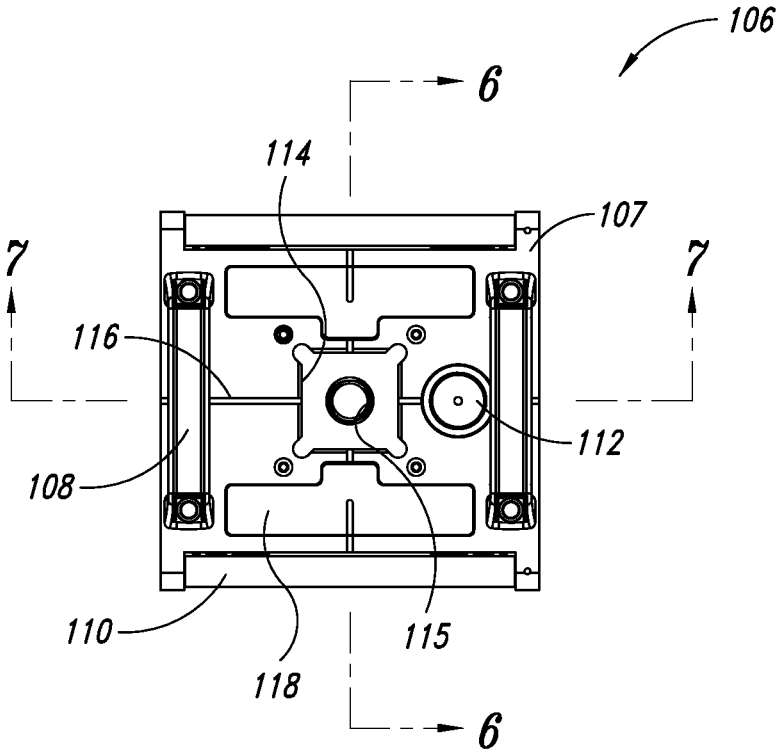
FIG. 5 is a top plan view of the installation assembly of FIG. 4.

Turning now to FIGS. 4 and 5, the installation assembly 106 is shown, according to an embodiment, in a side elevation view and top plan view, respectively. The installation assembly 106 includes a stiffener 158, as shown in FIG. 4, that is coupled to the top plate 107, positioned so as to fit within the stiffener cavity 120 of the elastomeric core 102 when the top plate and core are both properly coupled to the sleeve cap 104. The stiffener 158 fits snuggly in the stiffener cavity 120 to prevent distortion of the shape of the core under the weight and pressure of uncured concrete during formation of a post sleeve. A lower end 160 of the stiffener fits within the lower portion 128 of the elastomeric core 102, and includes, according to some embodiments, a replaceable tip 157 that extends through the aperture 129 of the core. According to other embodiments, the aperture 129 of the core 102 extends below the lower end 160 of the stiffener and provides a resilient seal against the stake 109. Because rubber and the like are not compressible, and pressure exerted by wet concrete at any given depth is substantially isostatic, the core 102 will not appreciably distort, except in response to the difference in pressure at different depths, provided there are no underlying gaps or cavities into which it can be moved by the pressure of the wet concrete. Distortion caused by fluid pressure differentials can be calculated and compensated for in the dimensions of the core 102, so that the core takes the desired final dimensions once it is submerged in the wet concrete. Thus, the elastomeric core 102 will produce a substantially accurate post sleeve shape in the concrete as it cures. On the other hand, when the stiffener 158 is absent, the core can be easily collapsed into itself for insertion and removal.

The stiffener 158 can be made of any material that is sufficiently strong to withstand the pressure of the uncured concrete in which the core 102 is positioned without appreciably deforming. It can be made, for example, from extruded aluminum, sheet metal, structural foam, or rigid plastic.

The clamps 110 of the installation assembly 106 include inwardly extending clamp flanges 156 configured to engage the rim 142 of the sleeve cap 104 as shown in FIG. 1, and are inwardly biased by springs 152 so that the assembly, the core 102, and the sleeve cap remain securely locked together until released by an operator. With the clamp flanges 156 engaging the rim 142 of the sleeve cap 104, the top plate 107 of the installation assembly 106 presses down on the rim 122 of the elastomeric core 102. The elastomeric material of the core 102 acts as a spring to bias the top plate 107 upward, which maintains the elements of the post sleeve assembly 100 in correct relative position. The operator releases the installation assembly 106 by grasping handles 154 of the clamps 110 and puling the clamps outward against the bias of the springs 152, as shown in FIG. 4. In this position, the clamps release the rim 142 of the sleeve cap. When the clamps 110 are released, the top plate 107 is pushed upward a small distance as the rim 122 of the elastomeric core 102 returns to its resting shape. This raises the clamp flanges 156 above the rim 142 of the sleeve cap 104 and prevents the clamps 110 from relocking when the operator allows them to return toward their normal positions.

The alignment guides 116 and bullseye level 112 are provided as means by which the operator can position the post sleeve assembly 100 during installation, so that it is plumb and properly oriented, or aligned with other post sleeves. The central cavity 114 of the installation assembly 106 is sized to receive the reference index 103. The index 103 is placed in the central cavity 114 and rests on a seat 117 (shown in FIG. 6) so as to extend from the installation assembly 106. A method for positioning a plurality of post sleeves using reference indices is described in the '434 patent previously referenced and incorporated. It will also be recognized that various embodiments of the present disclosure can be adapted for use with others of the installation structures and methods disclosed in the '434 patent.

An aperture 115 is provided with a top end at the bottom of the central cavity 114, coaxially with the central cavity, extending through the length of the stiffener 158, and sized to receive the installation stake 109. A corresponding aperture is provided at the bottom of the elastomeric core 102 to permit the installation stake to traverse the entire post sleeve assembly 100 along its longitudinal axis, so as to extend some selected distance from the bottom of the core. A locking mechanism is provided, preferably inside the stiffener to hold the installation stake at a selected position.

Figure 6:
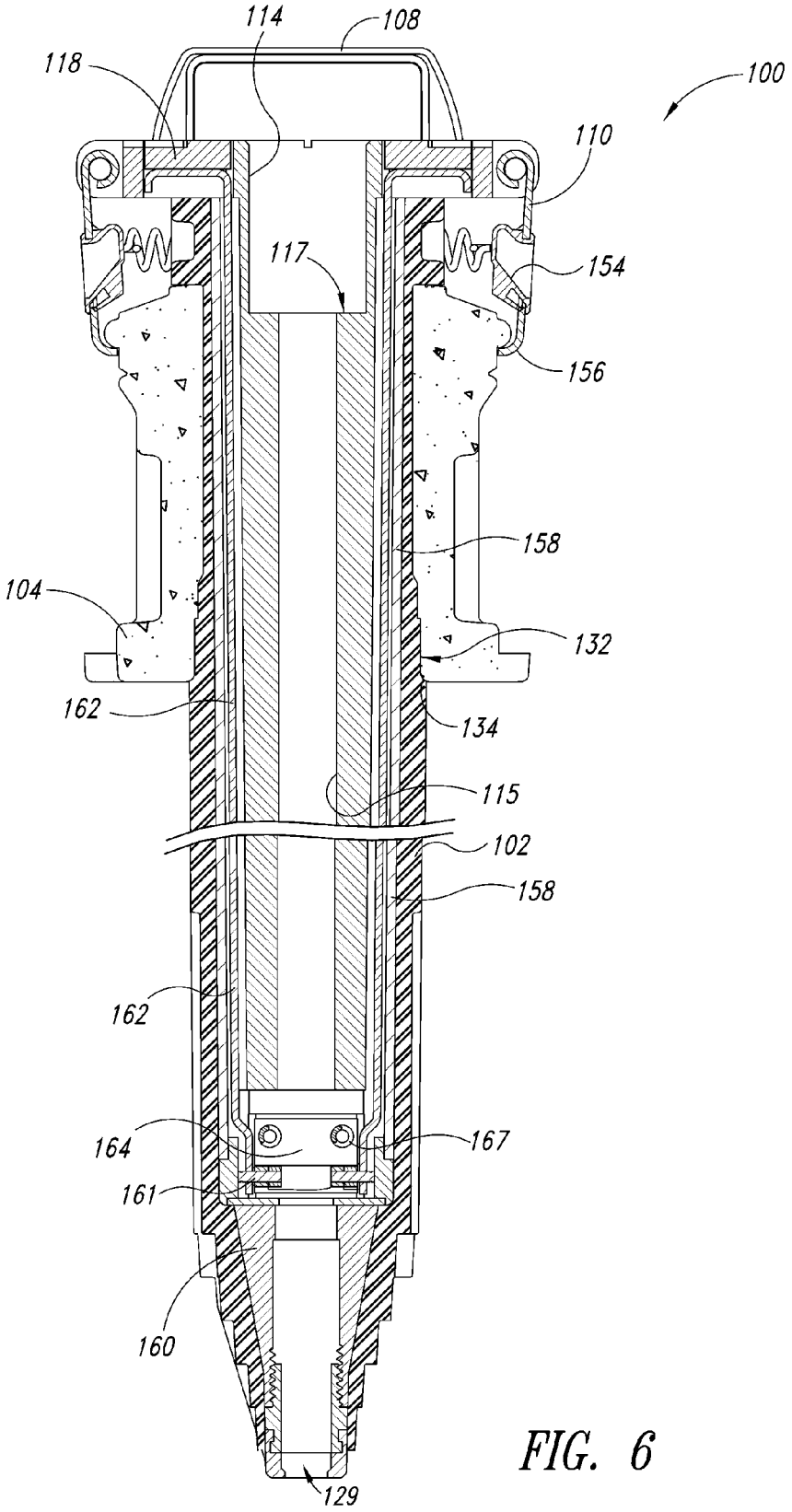
FIGS. 6 and 7 are cross-sectional views of portions of the post sleeve assembly of FIG. 1 taken along lines 6-6 and 7-7, respectively, of FIG. 5.
Figure 7:
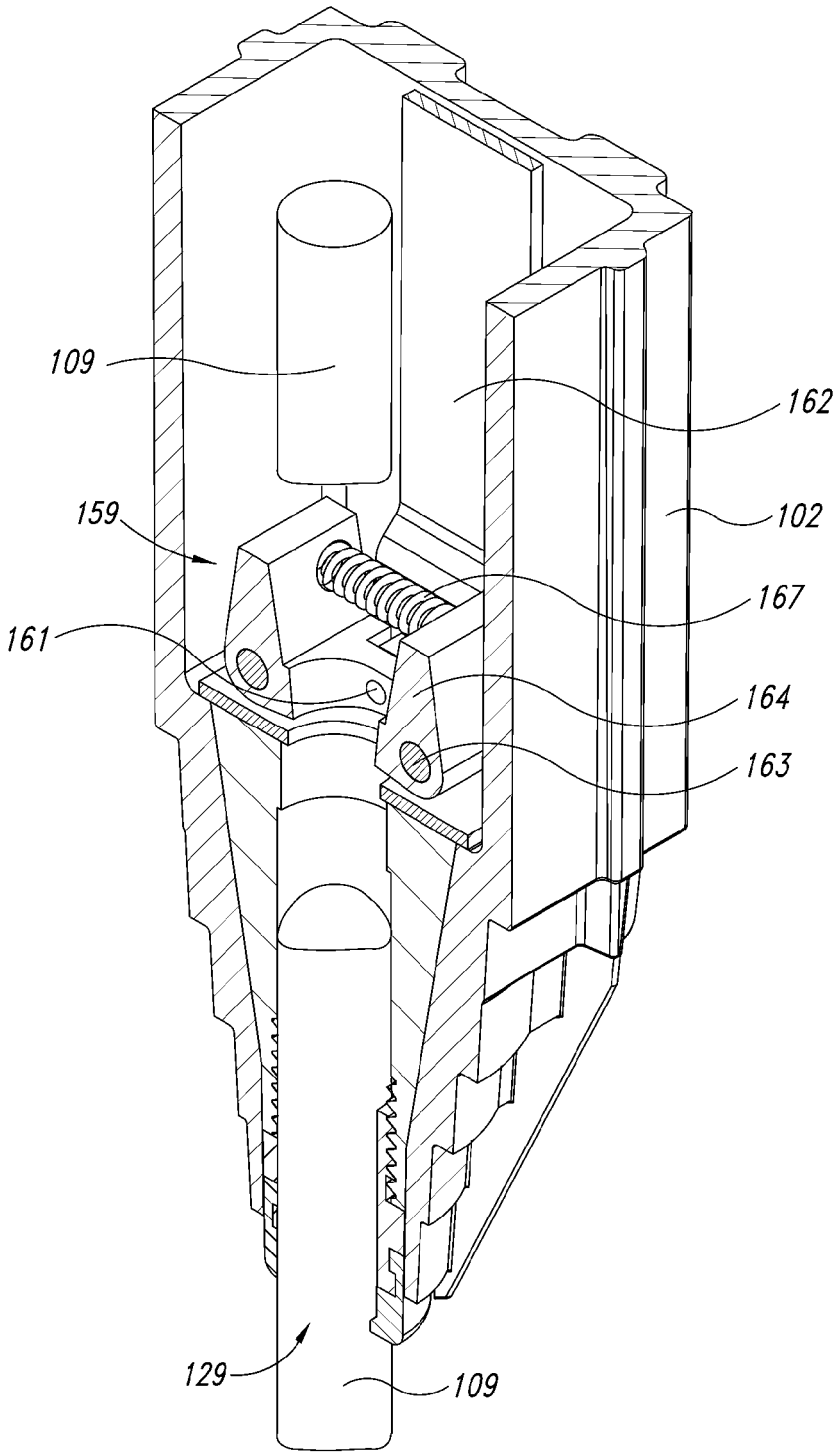

FIGS. 6 and 7 are cross-sectional views of portions of the post sleeve assembly 100 taken along lines 6-6 and 7-7, respectively, of FIG. 5, and showing details of the interior of the stiffener 158. As shown in FIG. 6, the cam release buttons 118 are coupled to first ends of cam release links 162 inside the top plate 107. The cam release links 162 extend inside the stiffener from the top plate toward the bottom end of the sleeve core 102, and are coupled at their second ends to a release pivot 161 which is in turn coupled to a pair of cams 164 of a locking mechanism 159, as shown in FIG. 7. A pair of cam springs 167 bias arms 165 of the cams 164, generally urging the cams to rotate outwardly around cam pivots 163. Outward rotation of the cam arms 165 causes jaws at the bottom edges of the cams to rotate inwardly. When an installation stake 109 is passed down through the aperture 115 it passes between the cams 164, causing them to rotate slightly away from the stake and permitting it to pass between them. However, if upward pressure is applied to the stake 109 while it is positioned between the cams 164, it applies a bias that cooperates with the cam springs 167, causing the jaws of the cams to grip the stake tightly, and preventing upward movement of the stake. When the operator presses the cam release buttons 118, the cam release links 162 move the cam release pivot downwardly, causing the cams to rotate against the cam springs 167, and releasing the installation stake 109, which can thus be removed. The installation stake is of particular use when deep footings are used, and explained below.

When a post is anchored in ground that is subject to a seasonal freeze/thaw cycle, the post can, over the course of a few seasons, be ejected from the ground by the expansion of water as it freezes. This occurs when water trapped below the footing of the post freezes, forcing the footing upward a small amount. In the spring, the ice thaws, leaving a gap that fills with more water, so that when the temperature drops and the water refreezes, the footing is raised further. One solution to this problem is the make the footing sufficiently deep that it extends below the local frost line. In some high-latitude regions, this depth can be more than four feet. Normally, to install a post sleeve an operator provides a post hole a few inches deeper than the length of the post sleeve plus the depth of any gravel drainage required. The post sleeve is placed in the hole and wet concrete is poured around it to fill the hole to about three-quarters of its depth. The operator then manually moves the post sleeve into the desired position, and finishes filling the hole. Buoyancy of the sleeve can be adjusted by adding weight to prevent the sleeve from floating too high in the wet concrete, and final adjustments are made to plumb and align the sleeve.

Figure 8:
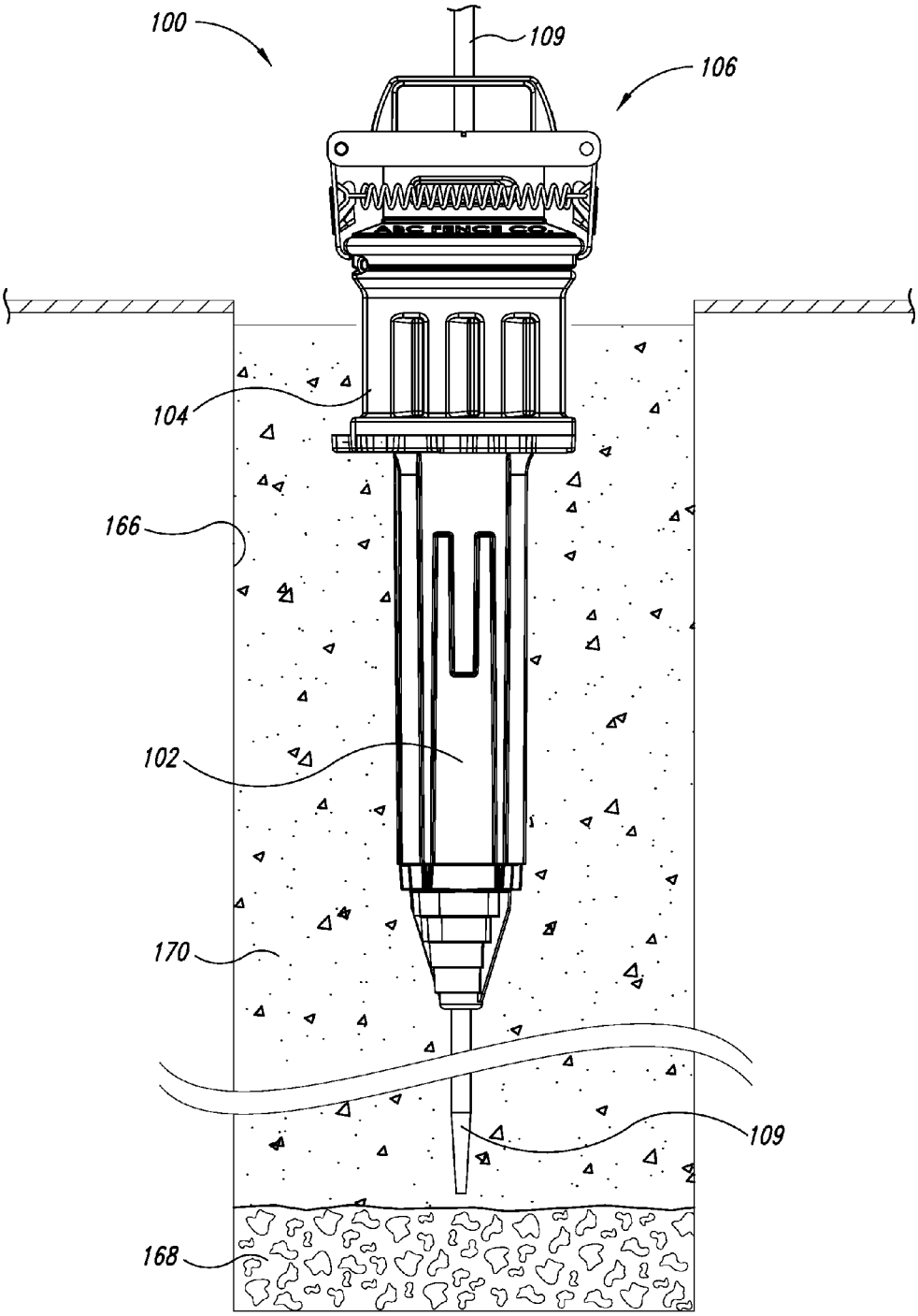
FIG. 8 is a side cut-away view of a post hole with a post sleeve assembly positioned therein.

However, if the footing must extend below a deep frost line, placing the post sleeve assembly in the hole might leave the top of the assembly two or three feet below ground level, which can complicate the installation. According to an embodiment, the installation stake 109 is provided to assist in such situations. FIG. 8 is a side elevation view of the post sleeve assembly 100 positioned in a post hole 166 and including the installation stake 109. In the example shown, the post hole 166 has a layer of gravel 168 for drainage, and is filled with concrete 170 to form a footing. The installation stake is preferably a steel bar, although it can be any material capable of supporting the weight of the post sleeve assembly 100.

Figure 9:
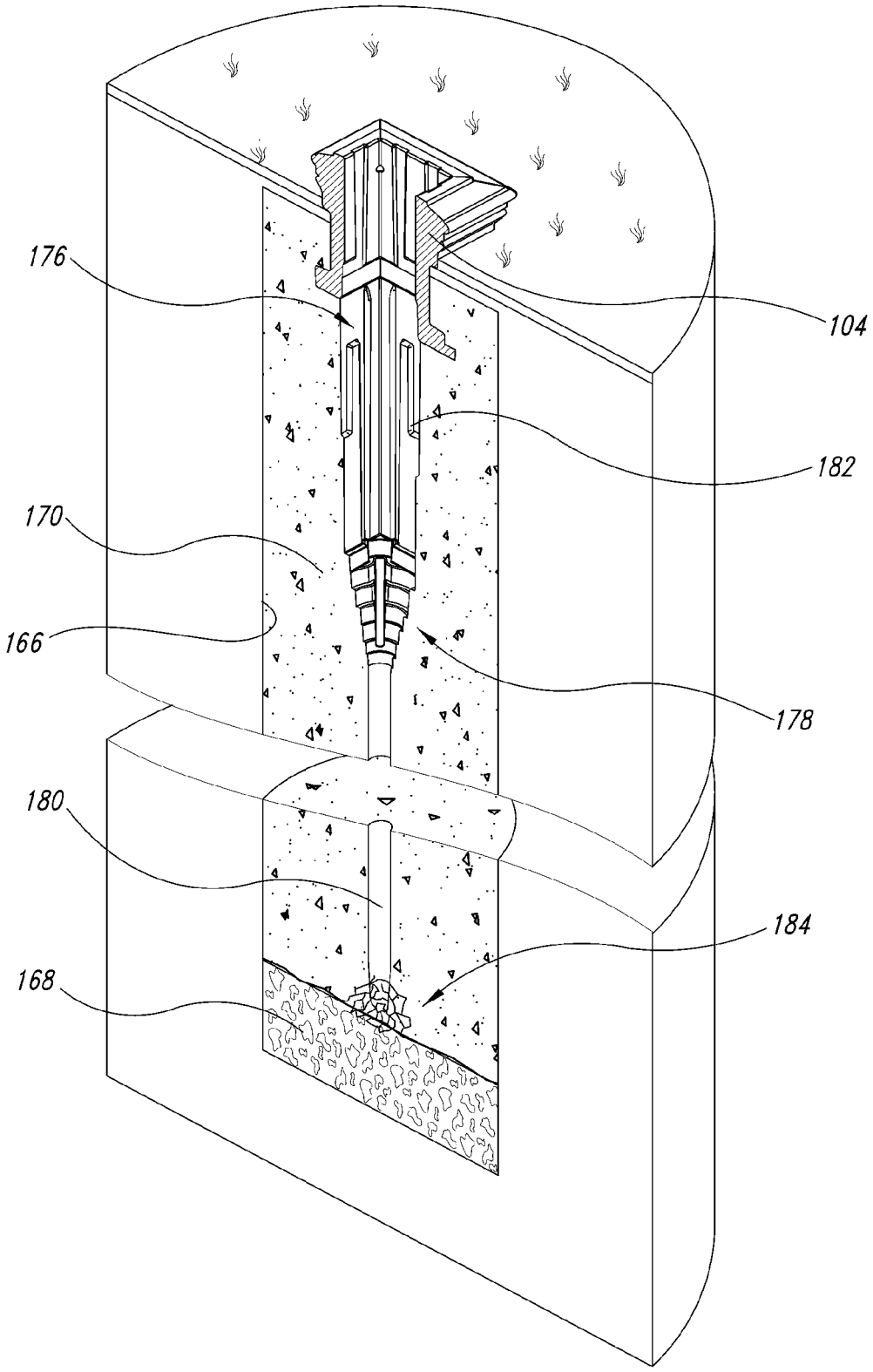
FIG. 9 is a side cut-away view of the post hole of FIG. 8 showing the permanent elements of the post sleeve.

Prior to placing the post sleeve assembly 100 in the hole 166, the stake 109 is positioned in the assembly 100 so as to extend a selected distance from the bottom of the assembly. The assembly 100 is then positioned in the post hole 166 so that the bottom end of the stake 109 rests on the bottom of the hole, supporting the post sleeve assembly at approximately the desired depth. As previously noted, the stake can easily slide downward, relative to the cams 164, so the operator can increase the height of the post sleeve assembly above the bottom of the hole 166 by lifting upward on one of the handles 108 of the installation assembly 106 while holding the stake 109 in place, causing the stake to slide downward between the cams 164. Once the post sleeve assembly 100 is at about the correct height, the hole 166 is filled and the final position and orientation of the sleeve assembly is adjusted, as previously described. The concrete footing 170 is allowed to cure, and the installation assembly is removed, leaving a complete post sleeve embedded in the footing 170, as shown in FIG. 9.

The installation stake 109 is preferably coated with a release agent to facilitate its removal after the footing is sufficiently cured. When the stake is withdrawn, it leaves a channel 180 in the footing, which permits water to drain to the gravel 168 below. It is anticipated that during the process of making the final adjustments to the position of the post sleeve assembly 100, the bottom end of the stake 109 may be lifted a few inches from the gravel bed 168, as shown in FIG. 8, permitting concrete to flow underneath, which would prevent drainage of water to the gravel. To overcome this problem, the operator strikes the top of the stake 109 with a hammer or small maul before removing the stake. This causes the stake 109 to drive down through the "green" concrete, fracturing the material directly below, as shown at 184 (FIG. 9), and opening a passage to the gravel 168. This can be done without any concern for the integrity of the footing as a whole because when concrete is freshly cured, it is relatively soft, so that any damage remains local to the point of impact, and does not propagate.

To remove the stake 109 from the installation assembly 106, the operator presses the cam release buttons 118 and pulls the stake from the assembly 100. To remove the installation assembly 106, the operator pulls outward on the handles 154 of the installation assembly, disengaging the clamps 110 from the rim 142 of the sleeve cap 104. The operator applies upward force to the handles 108, which lifts the installation assembly 106 from the sleeve cap 104 and pulls the stiffener 158 from the stiffener cavity 120. The operator can leave the installation stake 109 engaged by the locking mechanism and remove the stake and installation assembly 106 as a unit, or can remove the installation assembly and stake separately.

With the stiffener 158 removed, the post sleeve core 102 is pliable. The operator grasps the rim 122 of the core 102 and manipulates it to cause it to collapse sufficiently to be pulled from the sleeve cap 104 and the concrete footing. If necessary, the core 102 can be coated with a release agent prior to being placed in the post hole, to facilitate its later removal. In one embodiment, a vacuum attachment can be pressed on the top surface of the core 102 to cause it to collapse for removal. The concrete footing, having cured around the sleeve core 102, retains the features of the sleeve core, thereby forming the lower portion 176 of the post sleeve. In the embodiment of FIG. 9, the lower portion 176 includes plate stops 182, and a universal socket 178, which are described in detail in the detail in the '396 and '290 publications referenced and incorporated above.

The stiffener 158 has been described as part of the installation assembly 106, while the elastomeric core 102 has been described as a separate element. These relationships are for convenience and ease of description, but do not limit the scope of the claims. For example, according to various embodiments, the stiffener and elastomeric core comprise elements of a post sleeve core; according to other embodiments, the stiffener is configured to be positioned within a complete prefabricated post sleeve to guide and support the installation stake, so that no sleeve form, such as the elastomeric core, is required.

According to other embodiments that employ an installation stake, various alternative locking mechanisms are provided. For example, according to an embodiment, dimensions of the aperture 129 of the lower portion 128 of the elastomeric core 102 are selected to grip the installation stake 109 with sufficient force to support the weight of the post sleeve assembly 100, so that the stake will support the post sleeve assembly at the selected position during installation. According to another embodiment, a locking mechanism is provided in the tip 157 of the stiffener 158, such as a friction or compression coupling that provides adequate resistance to movement of the stake. During removal of the installation assembly 106, the tip 157 detaches from the stiffener 158 and remains attached to the stake 109.

According to an embodiment, a length of pipe or rigid tubing is coupled to the lower end 160 of the installation assembly 102 and serves, during installation, as an installation stake. When the installation assembly is removed, the pipe remains in the concrete footing to act as a drain channel for the post sleeve. The tip 157 can be configured to couple to the length of pipe, and can also be configured to be detachable from the stiffener so as to remain with the pipe when the stiffener and core are removed.

Figure 10:
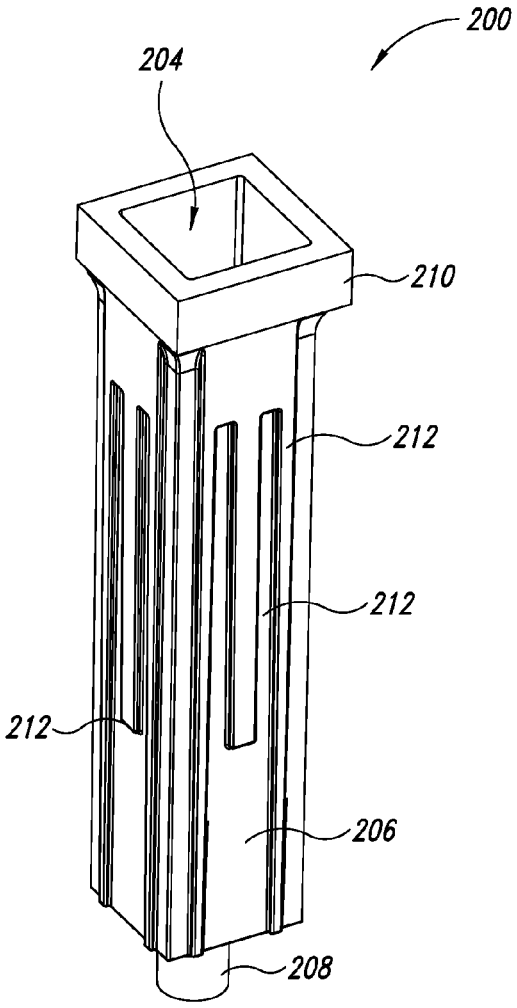
FIG. 10 is a diagrammatic perspective view of an elastomeric post sleeve core according to another embodiment.
Figure 11:
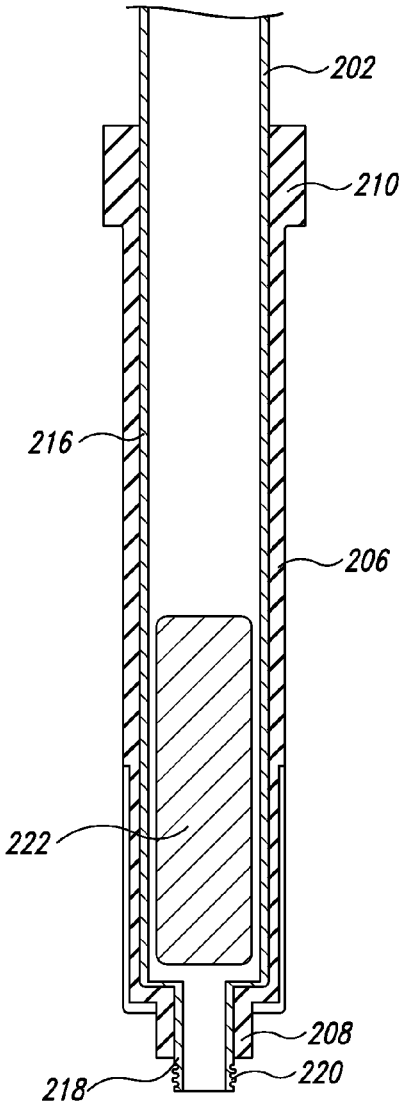
FIG. 11 is a diagrammatic cross-sectional view of the elastomeric post sleeve core of FIG. 10.

FIGS. 10 and 11 are, respectively, a perspective view and a cross-sectional view of an elastomeric post sleeve core 200 according to another embodiment. FIG. 11 also shows a stiffener 202 positioned in a stiffener cavity 204 of the core 200. The core 200 includes main body 206, a lower portion 208, and an upper portion 214. The main body 206 includes features 212 for forming, e.g., drain channels, stand-off ribs, and plate stops. Walls 216 of the stiffener 202 fit snuggly into the stiffener cavity 204 to provide the necessary support for the sleeve core 200. As shown in FIG. 11, a weight 222 can be positioned inside the stiffener 202 to give the combined core 200 and stiffener near neutral buoyancy in wet concrete, which allows the operator to more easily position and orient the combination before the concrete cures.

An extension portion 218 of the stiffener 202 extends from an opening at the bottom of the lower portion 208 of the core 200. The extension portion 218 is configured to be engaged by a piece of hose or tubing which remains in the footing after the stiffener 202 and core 200 are removed, to provide a drain passage to gravel or other drainage below. According to an embodiment, elastomeric ridges 220 are provided on the end of the extension portion 218, sized and configured to engage the threads of a standard garden hose coupling. An operator can cut an old garden hose to the necessary length and slide the bib coupling onto the extension portion 218 of the stiffener 202. The other end of the hose is buried in the gravel at the bottom of the hole before the hole is filled with wet concrete. After the footing has cured, the stiffener is pulled from the core, with the ridges 220 releasing the threads of the coupling as the stiffener is removed. The core is then also removed, as previously discussed.

The embodiment of FIGS. 10 and 11 is provided for use without a prefabricated sleeve cap. Instead, the operator places the core 200 in the footing at a depth at which the top of the footing reaches somewhere on the upper portion 210. When the core 200 is removed from the footing, post sleeve defined in the concrete by the core 200 has a corresponding upper portion that is smooth and regular in shape, and that can receive a collar that fits snuggly around a post positioned therein, to provide some protection from water and debris entering the sleeve.

Figure 12:
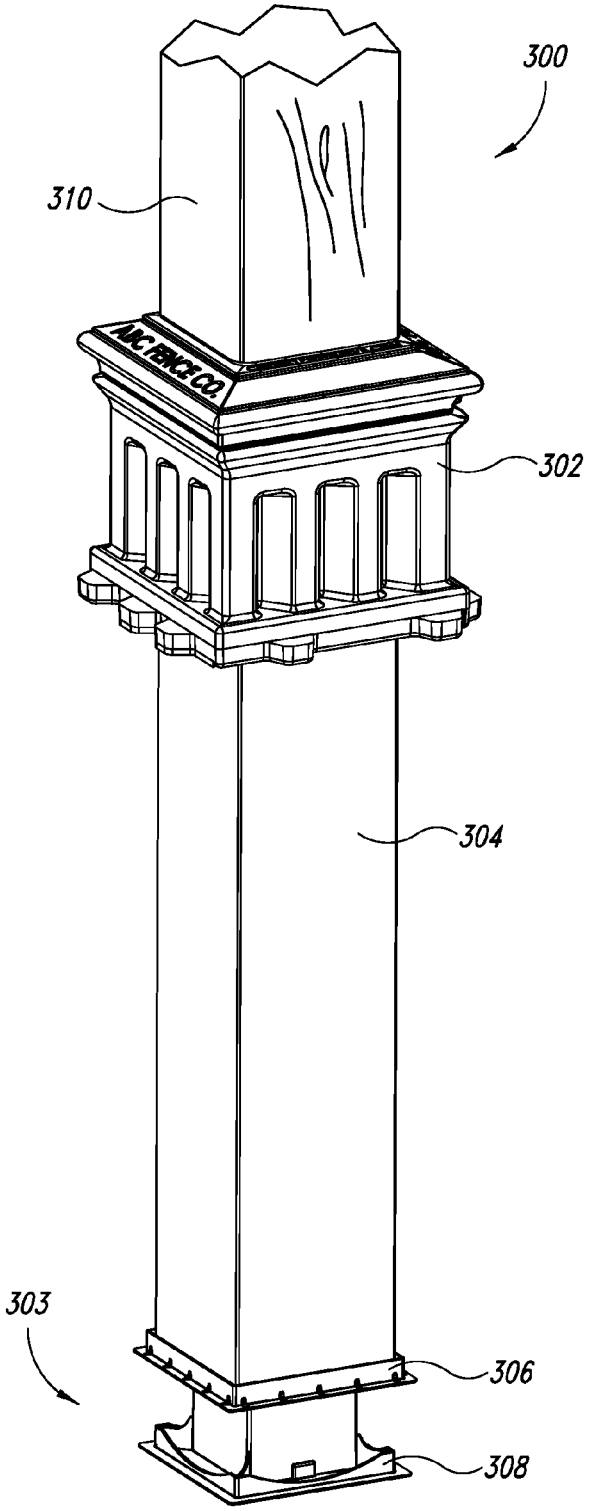
FIGS. 12 and 13 are, respectively, a perspective view and a cross-sectional view of a post sleeve assembly 300 according to another embodiment.
Figure 13:
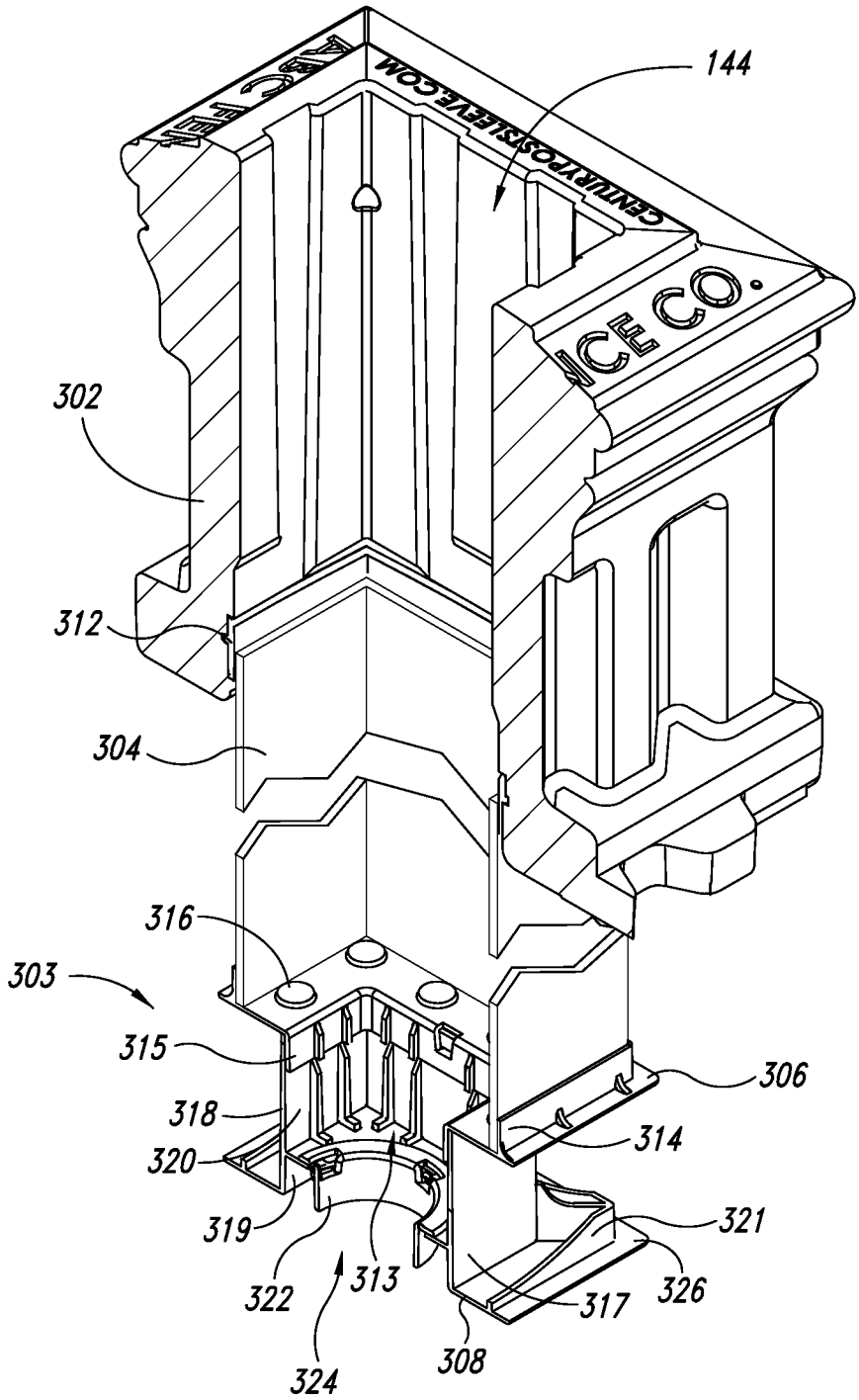

FIGS. 12 and 13 are, respectively, a perspective view and a cross-sectional view of a post sleeve assembly 300 according to another embodiment. FIG. 12 shows the assembly 300 with a post 310 in place, while the cross section of FIG. 13 shows details of the assembly in an enlarged view. The post sleeve assembly 300 includes a sleeve cap 302, an end cap 303, and a connecting "sock" 304, which is a sleeve in which the post 310 is placed for installation. The sock 304 can be made from any suitable material, including, for example, Tyvek®, polyethylene plastic, bubble wrap, etc.

The end cap 303 includes a first end cap segment 306 and a second end cap segment 308 that fit together in a friction or snap fit. The sock 304 is attached at a first end to a snap ring 312 that snaps into the lower end of the post aperture 144 of the sleeve cap 302. The sock 304 is attached at a second end to a sock flange 314 of the first end cap segment 306. The sock flange 314 is also configured to engage the lower end of the post aperture 144 by friction fit. While in storage and transit, the sock 304 is folded and positioned in the post aperture 144, with the sock flange 314 of the first end cap segment 306 engaged with the lower end of the post aperture 144 directly below the snap ring 312.

In addition to elements described above, the first end cap segment 306 includes standoff knobs 316, configured to receive the bottom end of a post and provide space for water to drain into a reservoir cavity 313 provided in the second end cap segment 308. A mating flange 315 extends downward from the first end cap segment 306, and is configured to couple with the second end cap segment 308.

A sidewall 318 of the second end cap segment 308 is configured to couple with the mating flange 315 of the first end cap segment 306 along a top edge 317 via a snap fit, and defines lateral dimensions of the reservoir 313. Additionally, the sidewall 318 is configured to couple with the mating flange 315 at a bottom edge 319 via a friction fit (as will be discussed in more detail below with reference to FIG. 16). The sidewall 318 is reinforced by ribs 320 to provide sufficient strength to support the post 310 and the sleeve cap 302 during installation. A storage flange 321 extends upward from a bottom plate 326 of the second end cap segment 308, and is configured to engage the upper end of the post aperture 144 of the sleeve cap 302 via a friction fit. During storage and transport, the second end cap segment 308 is positioned upside-down relative to the post sleeve 302 with the storage flange 321 engaged with the upper end of the post aperture 144.

A drain aperture 324 permits water to drain from the reservoir 313 to soil or gravel below the post sleeve. The drain aperture 324 can be sealed with a suitably durable adhesive sticker or degradable material to allow a stake to penetrate or water to escape after it degrades. A snap-in or twist-in aperture ring 322 is positioned in the drain aperture 324. The aperture ring 322 of the pictured embodiment provides a connection for a drain tube for drainage, for use in post sleeves where the second end cap segment 308 does not rest directly on soil or gravel. According to various embodiments, the aperture ring 322 can be removed or replaced with other elements that can be twisted (or snapped) into place, such as, e.g., a screen to prevent debris from passing through the drain aperture and clogging a drain field, an increased-volume drain reservoir, a holder for a slow-dissolving insecticide or insect repellant, etc.

During preparation for installation, an operator pulls the first and second end cap segments 306, 308 from the post aperture 144, snaps the top edge 317 of the second end cap segment to the bottom of the first end cap segment, and unfolds the sock 304 to its full length. The post 310 is positioned in the post sleeve assembly 300 and inside the sock 304, with the bottom end of the post engaging the sock flange 314. The sleeve cap 302 is positioned on the post so that the sock is fully extended, as shown in FIG. 12. The sleeve cap 302 can be fixed to the post during installation by any appropriate means, including, for example, by friction, jamming shims, a nail driven through a fastener aperture into the post, or by any of the fasteners described in the previously incorporated '396 and '290 patent application publications. The post 310 and post sleeve assembly 300 are then placed into a pre-prepared post hole, with the second segment 308 of the end cap 303 resting on the bottom of the hole. The hole is filled with wet concrete to a depth reaching a little below the rim of the sleeve cap 302, and the sleeve assembly is positioned and made plumb by manipulation of the post 110. Once properly positioned, the weight of the post is generally sufficient to overcome any buoyancy so as to keep the end cap firmly at the bottom of the hole, and all other forces are balanced. Thus, the post 310 and post sleeve assembly 300 will remain in position until the concrete cures. Alternatively, the post can be fixed in position until the concrete has cured, using any of a number of well known methods.

After the concrete has cured, the post can be left in place, or can be removed and replaced. The sock 304 prevents the concrete from adhering to the post, enabling later removal of the post without damage to the concrete footing. According to an alternative embodiment, a core having the appropriate lateral dimensions is used in place of the post, then removed after the concrete has cured.

One advantage of using a core is that it can be made fractionally larger than the dimensions of the selected post size, which will leave a post sleeve cavity that will permit easier removal and insertion of the post. Another advantage is that the core can be provided with features that the sock will follow when encapsulated by the concrete, permitting the formation in the post sleeve of drainage channels etc. On the other hand, if a post is used, installation of the combined post/post sleeve assembly is nearly identical to the installation of a typical fence or sign post. Thus, for example, a consumer can purchase post sleeve assemblies for the support posts of a residential fence. Once the assemblies are assembled on the respective posts, they can be fixed in concrete footings substantially as they would be if the posts were emplaced directly in the footings. After the footings have cured, the consumer or contractor can leave the posts in place and proceed to assemble the fence as normal, while still obtaining the benefit of a post sleeve with a durable and decorative opening, and from which the post can be removed and replaced without damage to the sleeve.

As noted above, the sock 304 can be made from any of a number of suitable materials. The selection of the material is a design consideration that may depend on a number of factors, such as the frequency with which the post is likely to be removed or replaced; the material and uniformity of the post; the climate where the post sleeve is to be installed, i.e., the amount of moisture that is likely to be introduced into the post sleeve over a given period; etc. If the post is smooth and uniform in shape, a thin sock material can be used, producing a post sleeve cavity that is very close in size to the dimensions of the post. Multiple layers of such thin material can also be used to make removal of the post easier. A thicker sock material can also simplify post removal and permit efficient drainage, and can also compensate for some irregularities in the shape of the post.

According to an embodiment, the sock is made from bubble wrap, which is a common and inexpensive material generally used in packaging. As is well known, bubble wrap typically comprises a first layer of polyethylene plastic in which round depressions are formed, and which is then laminated to a second layer of plastic, trapping air in the depressions. The result is a web layer with bubbles formed on one side. The thickness of the bubble wrap can be any appropriate value. For example, bubble wrap having a thickness of about ⅛ inch is commonly available. A sock made from such material will produce a sleeve cavity that is ¼ inch larger than the post, which permits simple removal and replacement of the post.

Figure 15:
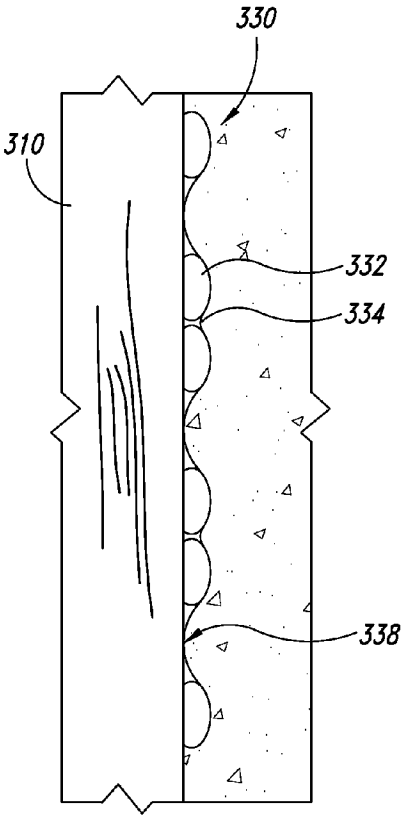
FIG. 15 is a diagrammatic cross section of the portion of FIG. 14, taken along lines 15-15.
Figure 14:
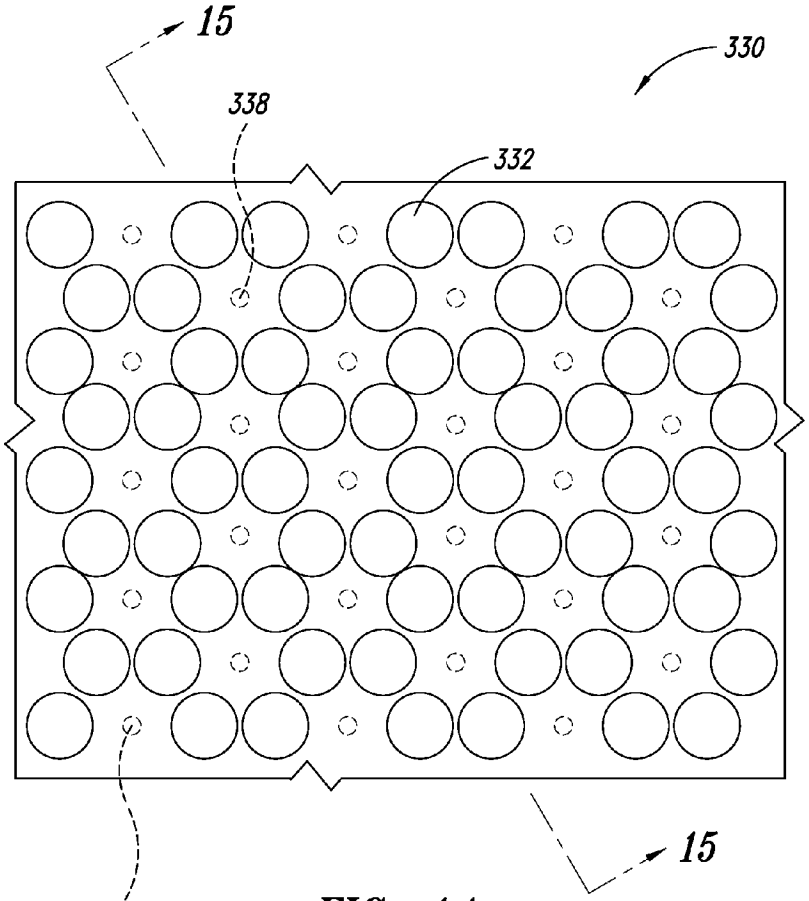
FIG. 14 shows a portion of a sock 330 made from bubble wrap, according to an embodiment, which includes a plurality of bubbles on a web layer.

FIG. 14 shows a section of a sock 330 made from bubble wrap, according to an embodiment, which includes a plurality of bubbles 332 on a web layer 334. FIG. 15 is a diagrammatic cross section taken along lines 15-15 of FIG. 14, showing the section 330 positioned between a post 310 and wet concrete 336, with the bubbles 332 on the side facing the post, and the web layer 334 on the side facing the wet concrete.

As compared to typical bubble wrap, selected ones of the plurality of bubbles 332 are absent from the exemplary pattern of FIG. 14, resulting in gaps at selected intervals. The pressure of the wet concrete 336 against the web layer 334 causes the web layer to sag inwards at the locations of the gaps, and touch, or nearly touch the post 310 at the centers 338 of the gaps. After the concrete cures, the bubble wrap can be removed, or left in place to deflate and disintegrate over time. In either case, the resulting post sleeve is formed with a plurality of small knobs in locations corresponding to the centers 338. A post positioned in the sleeve will be supported by the knobs, while moisture can easily drain around them to the bottom of the sleeve.

While bubble wrap can be manufactured according to any desired pattern, including the pattern shown in FIG. 14, it may be economically advantageous to use bubble wrap that is commercially available, instead of going to the expense of producing the tooling to make a custom pattern. According to an embodiment, a pattern of pin points is provided on a roller, over which lengths of standard bubble wrap are passed. The pin points are positioned so as to perforate selected ones of the bubbles, which then deflate, producing a desired pattern, such as, e.g., the pattern shown in FIG. 14.

Figure 16A:
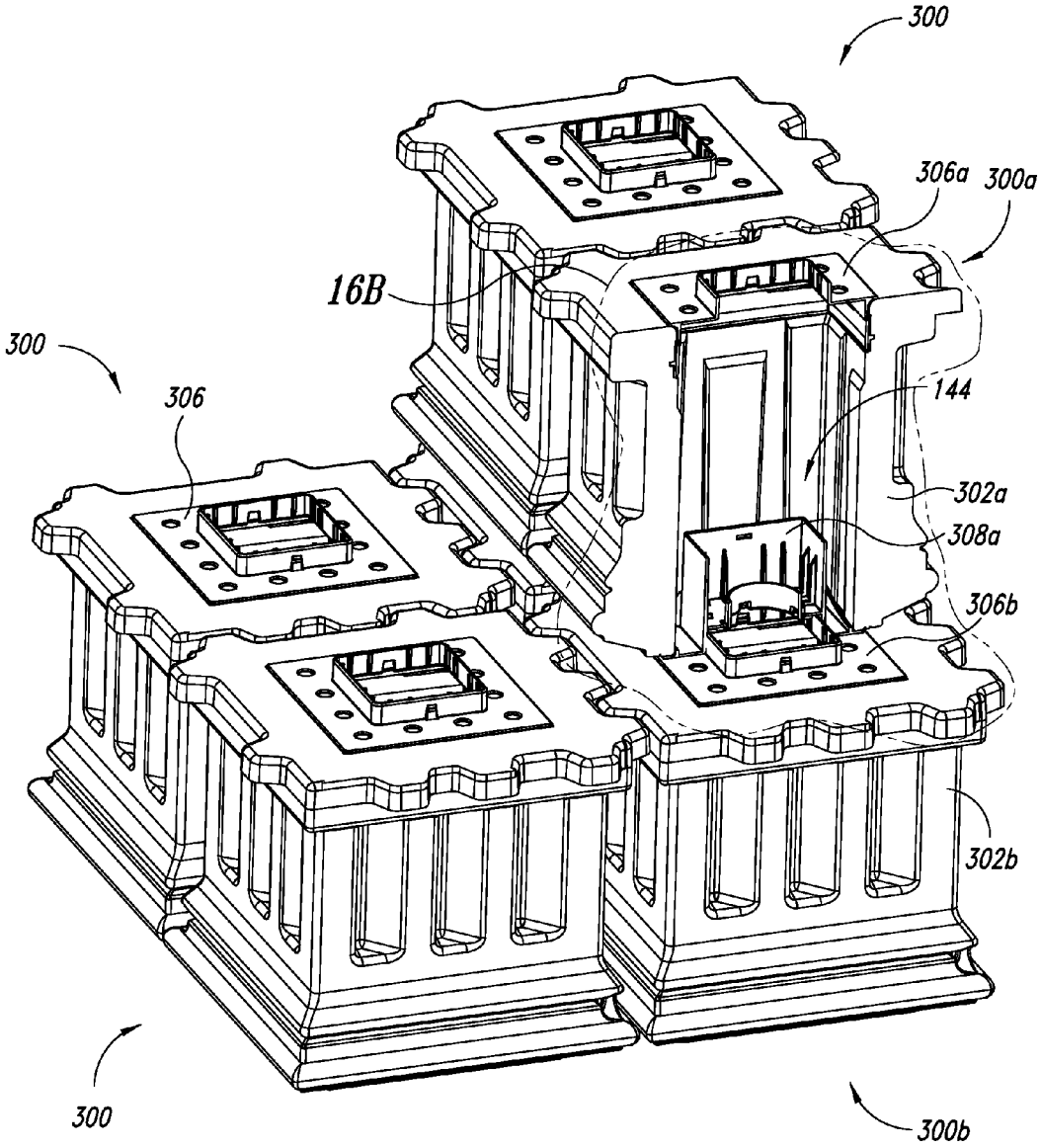
FIG. 16A is a perspective view of a plurality of post sleeve assemblies, according to an embodiment.
Figure 16B:
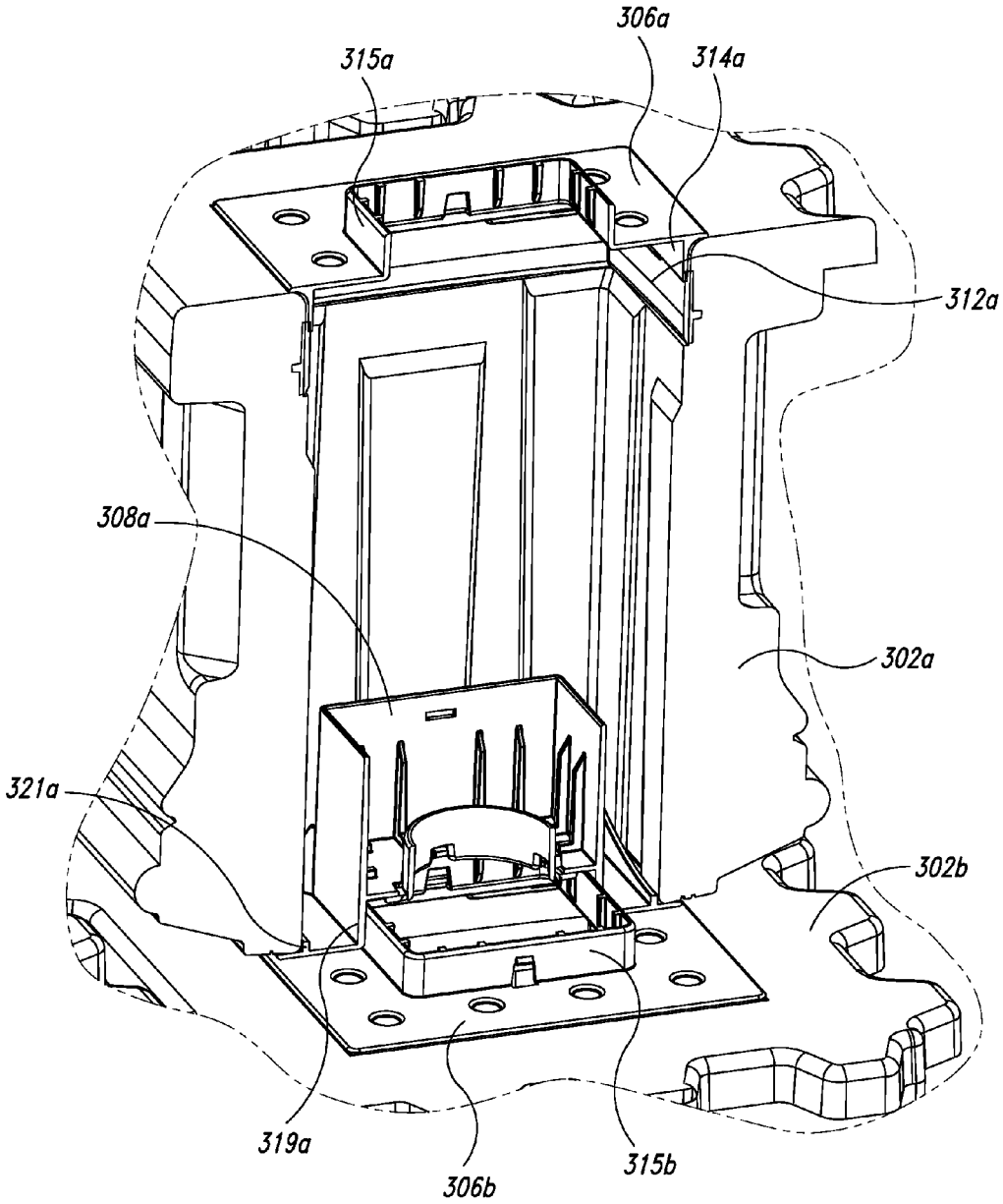
FIG. 16B is an enlarged view of the portion of FIG. 16A indicated in FIG. 16A at 16B.

Turning now to FIGS. 16A and 16B, a plurality of post sleeve assemblies 300 are shown, according to an embodiment; one post sleeve assembly 300*a* is shown in a partial cut-away view. FIG. 16B shows an enlarged view of the portion of FIG. 16A indicated at 16B, showing additional detail. A sock is not shown in FIGS. 16A and 16B in the post aperture 144*a*, but would normally be coupled at one end to the sock flange 314*a* and at the other end to the snap ring 312*a* and folded into the post aperture for storage and transport. The sleeve assemblies 300 are shown as they would be positioned relative to each other during storage and transport. The first end cap segment 306 of each is coupled to the lower end of the respective post aperture 144 and the second end cap segment 308 is coupled to the upper end, as previously described. The sleeve assemblies 300 are positioned top-side down on a pallet or equivalent supporting structure (not shown). Tabs 141 provided around the bottom of each sleeve cap 302 interlock with those of adjacent sleeve caps, and serve to prevent shifting of the sleeve caps relative to each other.

Post sleeve assembly 300*a* is shown stacked on top of post sleeve assembly 300*b*. The bottom edge 319*a* of the second end cap segment 308*a* of the post sleeve assembly 300*a* engages the mating flange 315*b* of the first end cap segment 306*b* of post sleeve assembly 300*b*. This maintains the post sleeve assembly 300*a* in alignment with the post sleeve assembly 300*b*, and prevents shifting of one relative to the other during transport. Portions of the first end cap segment 308*a* and of the second end cap segment 308*b* are interposed between the top of the sleeve cap 302*a* and the bottom of the sleeve cap 302*b*, preventing direct contact between the sleeve caps. This serves to protect from damage the upper rim 148*a* of the sleeve cap 302*a*, which will be visible after installation, and which may, in some embodiments, include decorative detail.

It can be seen that because of the interlocking elements of the post sleeve assemblies 300, they can be securely stacked and assembled, and will resist relative movement or shifting, thus improving safety and reducing breakage losses. FIG. 16 shows only a small number of post sleeve assemblies 300. In practice, the number of post sleeve assemblies per layer, and the number of layers will vary according to a number of factors, including size of the pallet, lifting capacity of handling machinery, available space for storage or transport, etc. While the post sleeve assemblies 300 are shown stacked in a top-side-down arrangement, they can also be stacked top-side-up, in which case provisions are preferably made to accommodate the mating flanges 315 of the first end cap segments 306, so that the weight of a stack of sleeve caps does not rest entirely on the mating flange of the lower-most assembly in each stack. Such provisions can include, e.g., appropriately positioned spacers or shims, or cavities formed in the top surface of a transport pallet, sized to receive the flanges.

According to another embodiment, a sock is provided, that is pulled over the bottom end of a post prior to placing the post in a wet concrete footing. The sock is preferably made of a material that has sufficient thickness that the post can be easily removed from the footing after it has cured. A plastic collar is provided, which permits the top of the sock to be stapled or nailed to the post.

It is well known that concrete continues to cure and harden for many years after being poured. Thus, the term cure, when used with reference to poured concrete, can be relative. For the purposes of the specification and claims, cured, and related terms, are to be construed as meaning sufficiently cured. Accordingly, where a claim recites, e.g., "removing the post sleeve core from the cured concrete," the "cured concrete" is concrete that is cured sufficiently for removal of the core without causing damage or distortion to the newly formed post sleeve.

In describing the embodiments illustrated in the drawings, directional references, such as upper, lower, top, bottom, etc., are used to refer to elements as they would be oriented when installed, or during installation. To the extent that such terms are used in the claims, they are to be construed accordingly.

Ordinal numbers, e.g., first, second, third, etc., are used according to conventional practice, i.e., for the purpose of clearly distinguishing between disclosed or claimed elements or features thereof. The use of such numbers does not suggest any other relationship, e.g., order of operation or relative position of such elements, nor does it exclude the possible combination of the listed elements into a single, multiple-function, structure or housing. Furthermore, ordinal numbers used in the claims have no necessary correspondence to those used in the specification to refer to elements of disclosed embodiments on which those claims read.

Where a claim limitation recites a structure as an object of the limitation, that structure itself is not an element of the limitation, but is a modifier of the subject. For example, in a hypothetical limitation that recites "a post sleeve configured to receive a post," the post is not an element of the claim, but instead serves to define the scope of the term post sleeve. Additionally, subsequent limitations or claims that recite or characterize additional elements relative to the post do not render the post an element of the claim.

The term coupled, as used in the claims, includes within its scope indirect coupling, such as when two elements are coupled with one or more intervening elements even where no intervening elements are recited.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

Elements of the various embodiments described above can be combined, and further modifications can be made, to provide further embodiments without deviating from the spirit and scope of the invention. All of the U.S. patent application publications and U.S. patents referred to in this specification are incorporated herein by reference, in their entirety. Aspects of the embodiments can be modified, if necessary to employ concepts of the various patents and applications to provide yet further embodiments.

These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled. Accordingly, the claims are not limited by the disclosure.

The invention claimed is:

1. A post sleeve installation system to assist in forming a post sleeve within a post hole in the ground to include a post sleeve cavity to insertably receive and support a post, the post sleeve installation system comprising:

a post sleeve core configured to be removed from a hardenable material that is deposited in the ground and used to form the post sleeve about the post sleeve core, the post sleeve core having an upper end and a lower end and having an exterior surface sized and shaped to define at least a portion of the post sleeve cavity of the post sleeve when the post sleeve core is removed from the hardenable material;

an elongate installation member removably coupleable to the post sleeve core and translationally adjustable relative to the post sleeve core to protrude a selected distance beyond a lower end of the post sleeve core to assist in positioning the post sleeve core at an elevated height within the post hole during formation of the post sleeve;

a locking mechanism coupled to the lower end of the post sleeve core and operable upon the elongate installation member, the locking mechanism resisting translation of the elongate installation member when in a locked state and enabling translation of the elongate installation member when in an unlocked state; and an actuatable release device coupled to the upper end of the post sleeve core which is operable by a user, the actuatable release device moving the locking mechanism from the locked state to the unlocked state and allowing translational movement of the elongate installation member in an upward direction relative to the post sleeve core upon actuation of the release device by the user.

2. The post sleeve installation system of claim 1 wherein the post sleeve core comprises:

an elastomeric sheath that defines the exterior surface of the post sleeve core and includes a stiffener cavity, the elastomeric sheath inwardly deformable to assist in removal of the elastomeric sheath from the hardenable material used to form the post sleeve about the post sleeve core; and a core stiffener removably insertable in the stiffener cavity of the elastomeric sheath to temporarily reinforce the elastomeric sheath while the hardenable material used to form the post sleeve is positioned around the elastomeric sheath and hardens to form the post sleeve.

3. The post sleeve installation system of claim 1, wherein the locking mechanism resists translation of the elongate installation member relative to the post sleeve core in at least an upward direction while the elongate installation member supports a weight of the post sleeve core as the post sleeve is formed about the post sleeve core.

4. The post sleeve installation system of claim 3 wherein the locking mechanism includes opposing cam members configured to resist translation of the elongate installation member relative to the post sleeve core in at least the upward direction while the elongate installation member supports the weight of the post sleeve core as the post sleeve is formed about the post sleeve core.

5. The post sleeve installation system of claim 1, further comprising:

a clamping mechanism coupled to the upper end of the post sleeve core and being configured to releasably engage a prefabricated post sleeve component selected to be deposited in the post hole and to suspend the prefabricated post sleeve component within the post hole such that the hardenable material and the prefabricated post sleeve component collectively form the post sleeve as the hardenable material hardens.

6. A post sleeve installation system to assist in forming a post sleeve within a post hole in the ground to include a post sleeve cavity to insertably receive and support a post, the post sleeve installation system comprising:

a post sleeve core configured to be removed from a hardenable material that is deposited in the ground and used to form the post sleeve about the post sleeve core, the post sleeve core having an upper end and a lower end and having an exterior surface sized and shaped to define at least a portion of the post sleeve cavity of the post sleeve when the post sleeve core is removed from the hardenable material;

a locking mechanism coupled to the lower end of the post sleeve core and movable between a locked state and an unlocked state, the locking mechanism configured to resist translation of an elongate installation member insertable in the post sleeve core when in the locked state and to enable translation of the elongate installation member when in the unlocked state to enable the post sleeve core to be selectively repositioned along a length of the elongate installation member; and an actuatable release device coupled to the upper end of the post sleeve core which is operable by a user, the actuatable release device moving the locking mechanism from the locked state to the unlocked state and allowing translational movement of the elongate installation member in an upward direction relative to the post sleeve core upon actuation of the release device by the user.

7. The post sleeve installation system of claim 6 wherein an upper portion of the exterior surface of the post sleeve core is shaped to be received within an interior cavity of a prefabricated post sleeve cap, and wherein the post sleeve core is elongated to protrude beyond the prefabricated post sleeve cap when coupled thereto.

8. The post sleeve installation system of claim 6 wherein the post sleeve core comprises:

an elastomeric sheath that defines the exterior surface of the post sleeve core and includes a stiffener cavity, the elastomeric sheath inwardly deformable to assist in removal of the elastomeric sheath from the hardenable material used to form the post sleeve about the post sleeve core; and a core stiffener removably insertable in the stiffener cavity of the elastomeric sheath to temporarily reinforce the elastomeric sheath while the hardenable material used to form the post sleeve is positioned around the elastomeric sheath and hardens to form the post sleeve.

9. The post sleeve installation system of claim 6, further comprising:

the elongate installation member, the elongate installation member being removably coupleable to the post sleeve core and translationally adjustable relative to the post sleeve core to protrude a selected distance beyond a lower end of the post sleeve core to assist in positioning the post sleeve core at an elevated height within the post hole during formation of the post sleeve.

10. The post sleeve installation system of claim 9 wherein the locking mechanism includes opposing cam members configured to resist translation of the elongate installation member relative to the post sleeve core in at least an upward direction while the elongate installation member supports a weight of the post sleeve core as the post sleeve is formed about the post sleeve core.

11. The post sleeve installation system of claim 6, further comprising:

a clamping mechanism coupled to the upper end of the post sleeve core and being configured to releasably engage a prefabricated post sleeve component selected to be deposited in the post hole and to suspend the prefabricated post sleeve component within the post hole such that the hardenable material and the prefabricated post sleeve component collectively form the post sleeve as the hardenable material hardens.

12. A post sleeve installation system to assist in forming a post sleeve within a post hole in the ground to include a post sleeve cavity to insertably receive and support a post, the post sleeve installation system comprising:

a post sleeve core configured to be removed from a hardenable material used to form the post sleeve about the post sleeve core, the post sleeve core having an upper end and a lower end and having an exterior surface sized and shaped to define at least a portion of the post sleeve cavity of the post sleeve when the post sleeve core is removed from the hardenable material;

a locking mechanism coupled to the lower end of the post sleeve core and movable between a locked state and an unlocked state, the locking mechanism configured to resist translation of an elongate installation member insertable in the post sleeve core when in the locked state and to enable translation of the elongate installation member when in the unlocked state;

an actuatable release device coupled to the upper end of the post sleeve core which is operable by a user, the actuatable release device being configured to move the locking mechanism from the locked state to the unlocked state and allow movement of the elongate installation member upon actuation of the release device by the user; and a clamping mechanism coupled to the upper end of the post sleeve core and being configured to releasably engage a prefabricated post sleeve component selected to be deposited in the post hole and to suspend the prefabricated post sleeve component within the post hole such that the hardenable material and the prefabricated post sleeve component collectively form the post sleeve as the hardenable material hardens.

* * * * *